US005663522A

United States Patent [19]

Kuehl

[11] Patent Number: 5,663,522

[45] **Date of Patent: *Sep. 2, 1997**

[54] M60 SEMI-AUTOMATIC CONVERSION

[76] Inventor: Robert Arnold Kuehl, 5820 Forest Grove Dr., Davenport, Iowa 52807

[ * ] Notice: The portion of the term of this patent subsequent to Aug. 20, 2012, has been disclaimed.

[21] Appl. No.: 110,188

[22] Filed: Aug. 20, 1993

[51] Int. Cl.[6] ..... F41A 19/32

[52] U.S. Cl. ..... 89/128; 42/69.02; 89/139

[58] Field of Search ..... 42/69.02; 89/128, 89/139, 166, 172, 185

[56] References Cited

U.S. PATENT DOCUMENTS

| | | | |
|---|---|---|---|
| 1,363,971 | 12/1920 | Hazelton | 42/69.02 |
| 4,704,945 | 11/1987 | Marcon et al. | 89/185 |
| 4,932,309 | 6/1990 | Barrett | 42/69.02 |
| 5,046,275 | 9/1991 | Brown | 89/128 |

FOREIGN PATENT DOCUMENTS

| | | | |
|---|---|---|---|
| 2937 | of 1885 | United Kingdom | 89/166 |
| 10450 | of 1887 | United Kingdom | 89/128 |
| 130021 | of 1919 | United Kingdom | 89/185 |

OTHER PUBLICATIONS

Chinn, George M., The Machine Gun, vol. IV, Parts X and XI, 1955, pp. 479, 509.

Jane's Infantry Weapons 1984–85, "7.62 mm M60 General–Purpose Machine Gun", 1984, p. 346.

Smith, Walter H.B., Small Arms of the World, 1948, pp. 72–74.

*Primary Examiner*—Michael J. Carone

[57] ABSTRACT

The M60 semi-automatic rifle (SAR) is a near clone of the U.S. military M60 machinegun, except the rifle is a modified version of the military gun. The M60 semi-automatic rifle differs functionally because it fires a single round with each pull of the trigger and fires with a closed bolt as opposed to multiple rounds fired with each pull of the trigger and firing from an open bolt of the M60 machinegun. Unique to the M60 SAR is a sear and interupter that travels with the bolt and is readily removable as an assembly, a firing pin that will indent the primer without operating rod assistance, and a design that has the Bureau of Alcohol Tobacco and Firearms approval for sale to Class 1 licensed dealers. The M60 semi-automatic rifle allows the military arms collector to have a functional near clone of the military machinegun without the expense and nuisance of registering a fully automatic machinegun.

2 Claims, 2 Drawing Sheets

M60 SEMI-AUTOMATIC CONVERSION

BACKGROUND OF THE INVENTION

The present invention relates generally to the M60 machinegun and in particular to the unique parts of the M60 semi-automatic rifle used to convert the M60 machinegun or to produce a near clone of the M60 machinegun that operates only in semi-automatic firing mode. Collectors of military arms are usually persons who have served in the military or who grew up during times of military conflict and are intrigued by military arms. They prefer to have arms they can function and fire for events sponsored by legitimate fraternal organizations. These look-alikes are sometimes fired at the local gun ranges. Similar conversions have been made for other machineguns, but none with the unique sear block that travels with the existing bolt and can be removed with the bolt as a unit for service. The present invention has other features uniquely different from the M60 machinegun such as a receiver that cannot be converted to a machinegun, a bolt hold open stop, adjustable trigger, striker firing system, firing pin bushed for high pressures and Bureau of Alcohol Tobacco and Firearms approval for sale through class 1 licensed dealers.

BRIEF DESCRIPTION OF DRAWINGS

The features of the M60 semi-automatic rifle (SAR) will become readily apparent to those skilled in the art from the following detailed description of a preferred embodiment when considered in the light of the accompanying drawings in which.

DESCRIPTION OF THE PREFERRED EMBODIMENT

Figure 1:
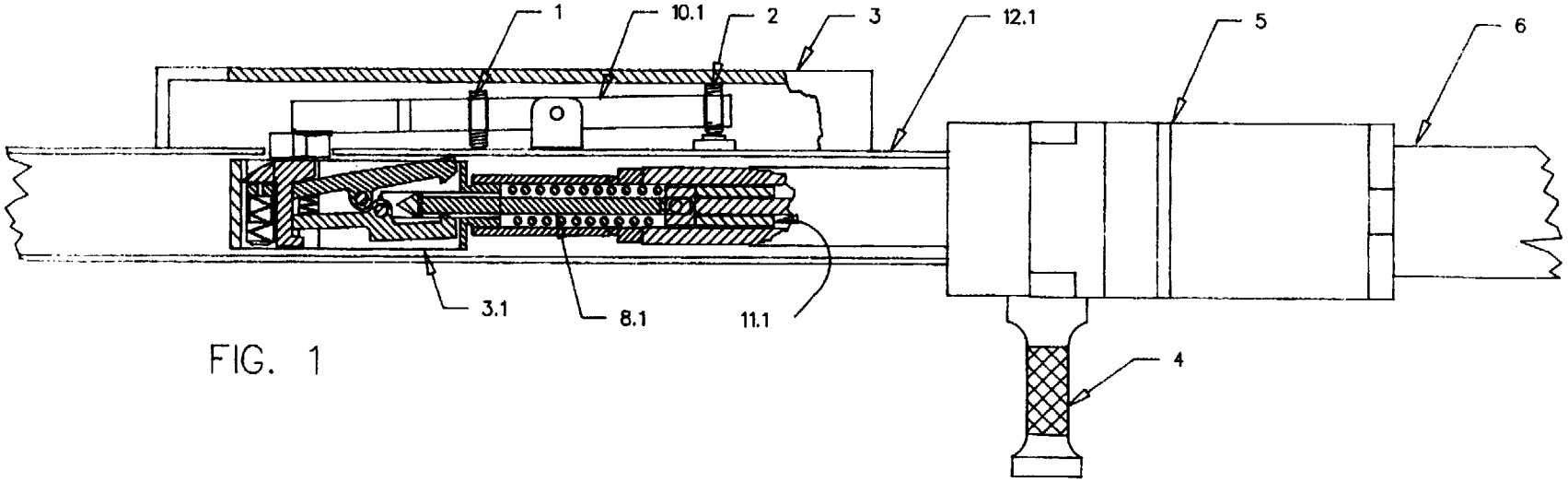
FIG. 1 is a perspective of the cross section of the bolt assembly in a cutaway top view of the M60 SAR receiver showing the firing pin fully cocked on the operating rod.

For purposes of promoting an understanding of the principles of the invention, reference will now be made to the embodiment illustrated in the drawings and specific language will be used to describe the same. It will nevertheless be understood that no limitations of the scope of the invention is thereby intended, such alterations and further modifications of the illustrated device, such equivalents, and such further applications of the principles of the invention as illustrated therein being contemplated as would normally occur to one skilled in the art to which the invention relates. Refer now to FIGS. 1 through 4 that show the significant parts that are the functional and unique to this embodiment.

Figure 4:
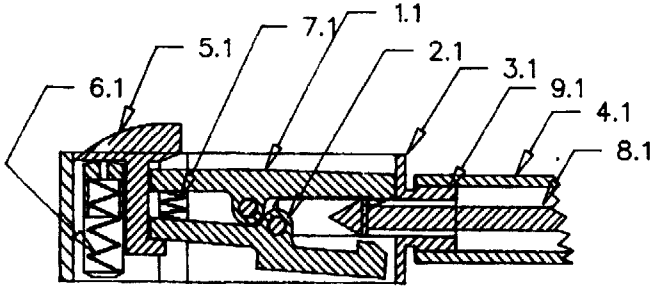
FIG. 4 shows an enlarged cross section of the M60 SAR sear block assembly with the firing pin on the primary sear ready-to-fire. This figure is an enlargement of the sear block assembly shown in FIG. 3.
Figure 2:
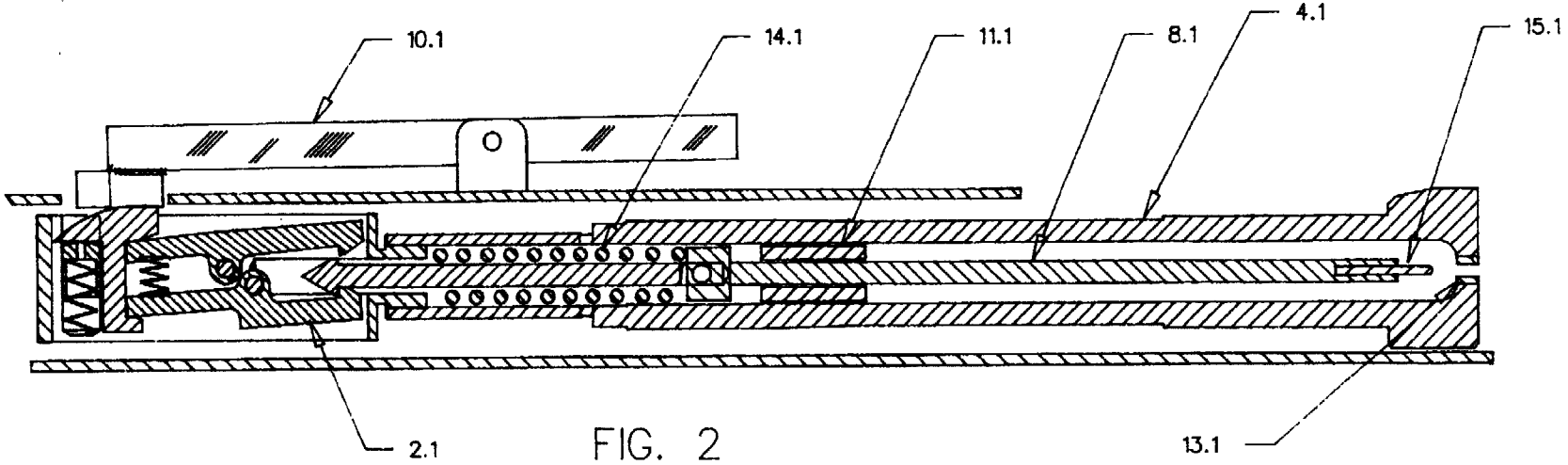
FIG. 2 shows a cross section of the bolt assembly in the receiver of the M60 SAR after firing but before the trigger is released from the previous shot.
Figure 3:
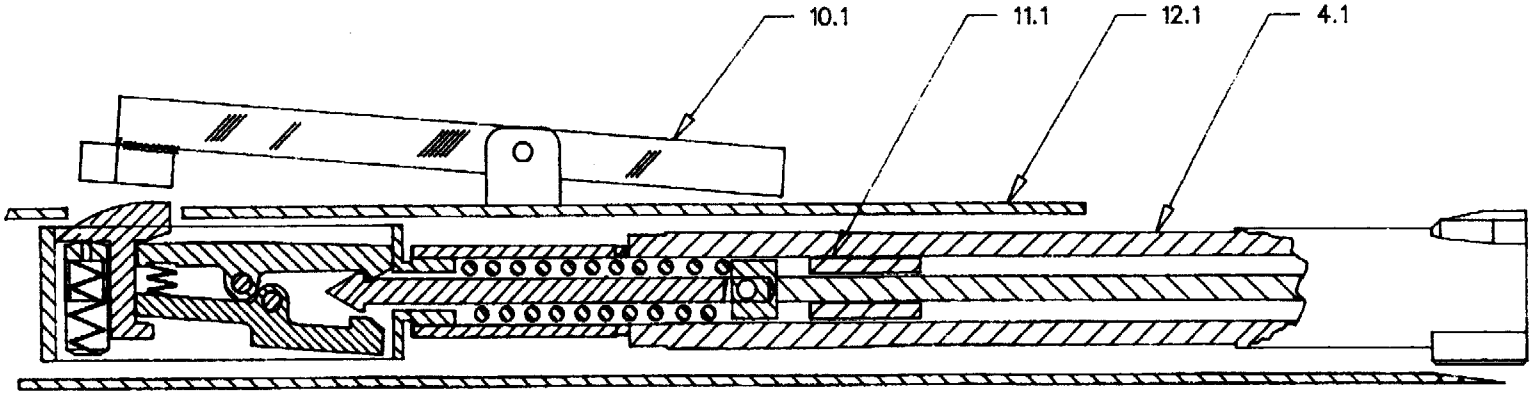
FIG. 3 shows the cross section of the bolt assembly in the receiver of the M60 SAR in a ready-to-fire condition after releasing the trigger from the previous shot.

The M60 semi-automatic rifle (SAR) is partially shown in FIGS. 1 through 4. FIG. 1 shows the trigger bar 10.1 holding the C-section 5.1 (FIG. 4) so the interupter 2.1 is engaged with the firing pin 8.1 which is fully cocked by the operating rod 11.1. When the operating rod 11.1 returns home from its return spring force, the firing pin 8.1 rests on the interupter 2.1 as shown in FIG. 2. because the trigger bar 10.1 is still in position from the previous shot, or the C-section 5.1 is still inside the receiver wall 12.1, FIG. 3 before the bolt traveled completely forward in the receiver. When the trigger bar 10.1 releases the C-section 5.1, the interupter 2.1 releases the firing pin 8.1 which is caught by the primary sear 1.1 now in position and the M60 SAR is ready to fire again as shown in FIG. 3. FIG. 1 shows the tapped holes 1&2 in the trigger bar 10.1 to limit depression of the C-section 5.1, and trigger travel. Also shown in FIG. 1 is the cover 3 for the trigger bar 10.1. The receiver body 5 and barrel assembly 6 and cocking handle 4 are also shown for perspective. FIG. 4 shows the enlarged cross section view of the sear block assembly 3.1 and the associated part that attach to the M60 machinegun bolt 4.1 by the threaded connection 9.1 which also acts as a pivot during locking and unlocking of the bolt 4.1 from the barrel assembly 6. Notice that the independent action of the interupter 2.1 and the primary sear 1.1 allow the primary sear 1.1 to be fully engaged before the interupter 2.1 releases the firing pin 8.1. The sear spring 7.1 is compressed further by the C-section return spring 6.1 when the C-section 5.1 protrudes through the receiver wall 12.1 and the trigger bar 10.1 has been released. FIG. 2 shows the operating rod 11.1 fully forward with the bolt 4.1 in the locked position and the firing pin 8.1 on the interupter 2.1 because the trigger bar 10.1 is fully depressed. The relationship between the operating rod 11.1 in the bolt cam slot (not shown) and the firing pin 8.1 preclude modification to full automatic operation. The M60 machinegun uses the operating rod 11.1 as a hammer for firing pin energy whereas the M60 SAR utilizes the firing pin spring 14.1 as the energy source thereby functioning as a striker system. The short firing pin travel and striker system greatly reduce the chance of a slam fire (firing without a pull of the trigger) if the primary sear 1.1 should fail to engage the firing pin 8.1. Note the bushing 13.1 in the bolt 4.1 FIG. 2 that reduces the firing pin tip diameter for greater resistance to piercing primers of high pressure cartridges. A letter from the Bureau of Alcohol, Tobacco, and Firearms, Washington, D.C. 20226 to Mr. David Reese, Rock Island Armory, 911 West Main Street, Geneseo, Ill. 61265, DTD 8 Aug. 1991 approves the design and classifies it as a firearm as that term is defined in section 921 (a) (3) (A), Chapter 44, Title 18, U.S.C.

What is claimed and is desired to be secured by Letters Patent of the United States:

1. Parts used to convert a M60 machinegun open bolt firearm to, or to manufacture a M60 semi-automatic to a closed bolt firearm comprised of a modified M60 Machinegun receiver, a trigger bar for actuating the firing and containing adjustments to control trigger action, a sear block containing a pivoted interrupter and a pivoted primary sear, said sear block being pivotally connected to the bolt, and a striker that is compatible with the pivoted sear and interrupter.

2. A sear block as cited in claim 1 that contains a sear and interrupter that are controlled by an element and springs to catch and release a striker and can be attached to a bolt or reciprocating breechbolt of a firearm.

* * * * *